United States Patent [19]

Yamashita et al.

[11] 3,975,199

[45] Aug. 17, 1976

[54] SILVER HALIDE PHOTOGRAPHIC EMULSION

[75] Inventors: Hiroshi Yamashita; Yutaka Sakasai, both of Asaka, Japan

[73] Assignee: Fuji Photo Film Co., Ltd., Minami-ashigara, Japan

[22] Filed: Dec. 18, 1974

[21] Appl. No.: 534,120

[30] Foreign Application Priority Data

Dec. 18, 1973 Japan ..... 48-142205

[52] U.S. Cl. ..... 96/100; 96/108; 96/125; 96/124; 96/126

[51] Int. Cl.[2] ..... G03C 1/28; G03C 1/08

[58] Field of Search ..... 96/108, 110, 100, 125, 96/124, 126

[56] References Cited

UNITED STATES PATENTS

| | | | |
|---|---|---|---|
| 2,843,490 | 7/1958 | Jones | 96/108 |
| 3,282,700 | 11/1966 | Figueras et al. | 96/108 |
| 3,312,547 | 4/1967 | Levy | 96/1.5 |
| 3,656,962 | 4/1972 | Levy | 96/108 |
| 3,804,634 | 4/1974 | Shiba et al. | 96/125 |

*Primary Examiner*—Won H. Louie, Jr.

*Attorney, Agent, or Firm*—Sughrue, Rothwell, Mion, Zinn & Macpeak

[57] ABSTRACT

A silver halide photographic emulsion having improved sensitivity and comprising an emulsion containing photosensitive silver halide crystals and a solid basic metal oxide selected from the group consisting of magnesium oxide, calcium oxide and a compound oxide of zinc and aluminum.

12 Claims, 4 Drawing Figures

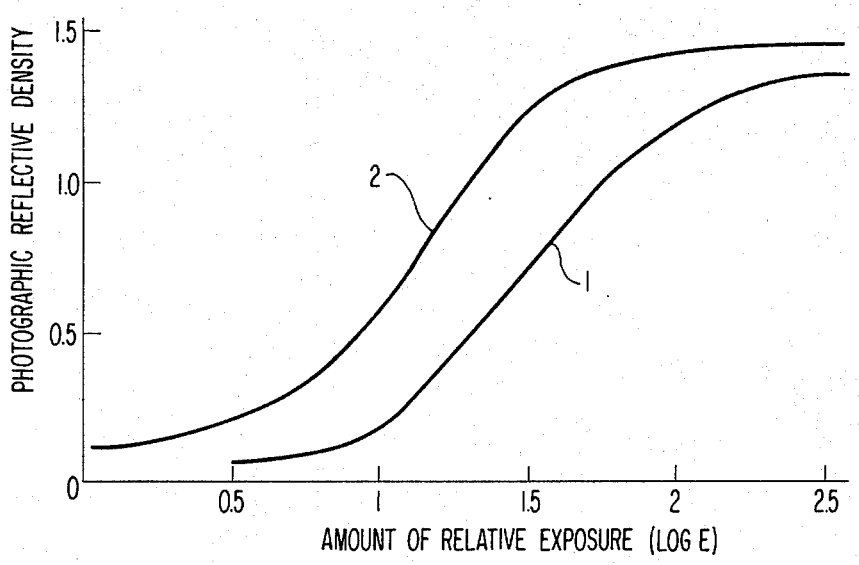
FIG. 1
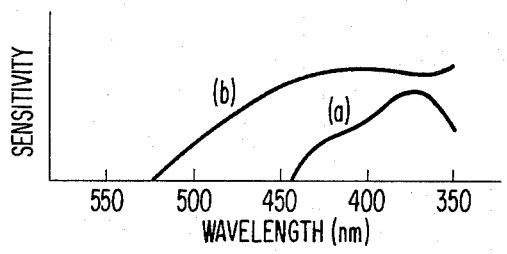
FIG. 2
FIG. 3
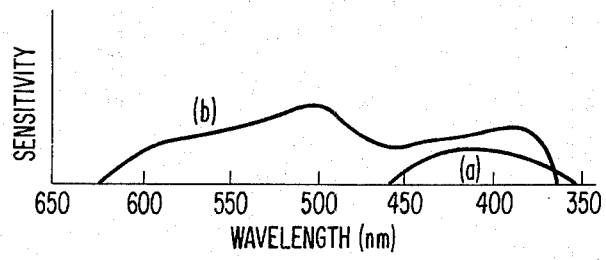
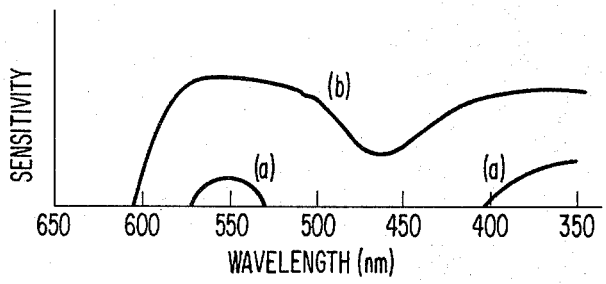
FIG. 4

SILVER HALIDE PHOTOGRAPHIC EMULSION

BACKGROUND OF THE INVENTION

1. Field of the Invention

The present invention relates to photographic emulsions by which radiation images (including X rays, electron rays, ultraviolet rays, visible rays and infrared rays) can be recorded. In greater detail, the present invention relates to silver halide photographic emulsions having improved photosensitive properties (sensitivity and sensitive range) to radiation.

2. Description of the Prior Art

The prior art concerning sensitization of silver halide photosensitive materials can be divided into chemical sensitization and spectral sensitization. In chemical sensitization, various sulfur compounds, for example, compounds described in U.S. Pat. Nos. 1,574,944, 1,623,499 and 2,410,689; various gold salts (including complex salts), for example, the compounds described in U.S. Pat. Nos. 2,597,856 and 2,597,915 such as potassium chloroaurate and auric chloride; and reduction compounds, for example, the compounds described in U.S. Pat. No. 2,487,850 such as stannous chloride are used for silver halide emulsions. With chemical sensitization, it is possible to increase the sensitivity of the silver halide in the inherent sensitivity wavelength range of silver halide.

In spectral sensitization, it is possible to provide photosensitive properties in a wavelength range which is on a longer wavelength side of the inherent sensitivity wavelength range of silver halide by adding polymethine dyes (e.g., aninidium ion type cyanine dyes or merocyanine dyes) alone or together with other dyes to silver halide emulsions. Spectral sensitizers suitable for such purpose have been described in detail in F. M. Hamer *The Cyanine Dyes and Related Compounds*, Interscience Publishers (1964) and C. E. K. Mees & T. H. James *The Theory of the Photographic Process* 3rd Ed., The Macmillan Company, (1966).

In both chemical sensitization and spectral sensitization, the sensitizers are used in a small amount, i.e., as little as $10^{-6} - 10^{-4}$ mol of sensitizer per mol of silver halide.

If used in a large amount, undesirable phenomena such as a generation of fog or a decrease of sensitization efficiency occur.

SUMMARY OF THE INVENTION

Therefore an object of the present invention is to provide novel silver halide photographic emulsions which have improved sensitivity to active incident rays (radiations) and are effective to form silver images by use of a sensitizer which is harmless to humans and animals.

Another object of the present invention is to provide novel silver halide photographic emulsions which are not contaminated by the color of the sensitizer.

A further object is to provide novel silver halide photographic emulsions wherein the spectral sensitizing function of a spectral sensitizer is enhanced.

An even further object is to provide silver halide photosensitive materials wherein the degree of desensitization in the inherent sensitivity range of silver halide is small when spectral sensitization is conducted.

Also an object is to provide silver halide photosensitive materials by which the developing time can be shortened.

It has now been found that the sensitization effect is enhanced remarkably not only in the inherent sensitivity range of silver halide but also in the spectral sensitization range by use of a certain kind of solid basic oxide, as described below, which does not have an absorption itself in a visible range.

Accordingly the silver halide photographic emulsion of the present invention comprises an emulsion containing photosensitive silver halide crystals and a solid basic metal oxide selected from the group consisting of magnesium oxide, calcium oxide and a compound oxide of zinc and aluminum.

BRIEF DESCRIPTION OF THE DRAWINGS

FIG. 1 shows characteristic curves of silver chloride emulsions wherein the prior art (curve 1) and the present invention (curve 2) are compared.

FIG. 2 shows spectra of the spectral sensitivity of silver chloride emulsions wherein curve (*a*) is the prior art and curve (*b*) is the present invention.

FIG. 3 shows spectra of the spectral sensitivity of silver bromide emulsions wherein curve (*a*) is the prior art and curve (*b*) is the present invention.

FIG. 4 shows spectra of the spectral sensitivity of silver chloride emulsions which are sensitized with erythrosine wherein curve (*a*) is the prior art and curve (*b*) is the present invention.

DETAILED DESCRIPTION OF THE INVENTION

As the solid basic oxide used in the present invention, the oxides of metals of Group II*a* in the periodic table and the compound oxides of metals of Group II*a* and III*a* are employed. Those metal oxides which are substantially colorless are particularly preferred. This is because the addition of the oxide to the emulsion in an amount such that the emulsion is colored results in serious defects, for example, color reproduction deteriorates in the case of an emulsion for color negatives, color contamination occurs in the case of an emulsion for reversal films or for color papers, or the fog density increases in the case of an emulsion for lithofilms.

Examples of these basic metal oxides are magnesium oxide, calcium oxide and the compound oxide of zinc and aluminum, etc. These compounds can be used along or as a mixture thereof. In using the compounds as a mixture, they are preferably used in a weight ratio of about 1:10 to 10:1. Of course, the ratio is not limited to this range, and the ratio can be decided based on conventional routine testing.

Further, the metal oxide can be used together with a solid acid metal oxide which does not exhibit and photographic effect (e.g., sensitization, gamma ($\gamma$) or D max, etc.) if used alone (e.g., aluminum oxide, titanium oxide, vanadium oxide or cerium oxide etc.). Although the ratio of the basic oxide and the acid oxide is not limited, a weight ratio ranging from about 1:10 to 10:1 is preferred. Magnesium oxide and calcium oxide are particularly preferred as the solid basic oxide. If magnesium oxide and aluminum oxide are used together, a particularly excellent result can be obtained. Other solid basic oxides and acid oxides which can be used are described in Kozo Tanabe, *Solid Acids and Bases* Academic Press (1970).

The photosensitive silver halide can be any known silver halide. Examples of such silver halides include silver chloride, silver bromide, silver iodide, silver bromochloride and silver iodobromide, etc. The effect brought about by the addition of the solid basic oxide (including its use together with an acid oxide) is obtained in not only black-white photographic emulsions but also color photographic emulsions. The time of addition of the basic oxide can be suitably chosen. For example, the basic oxide can be incorporated in the system during formation of silver halide crystals or it can be added to the system after formation of the silver halide crystals. Preferably, the basic oxide is added before application of the emulsion to the support.

Where the emulsion is spectrally sensitized in the present invention (including the case of supersensitization), the spectral sensitization can be by a method which comprises adding a solution of a polymethine dye (e.g., cyanine dyes, merocyanine dyes, styryl bases or hemicyanine dyes, etc.) or other dyes (e.g., xanthene derivatives or acridine derivatives, etc.) in water or in an organic solvent to the emulsion of the present invention, and a method which comprises adsorbing the above described spectral sensitizers on the silver halide particles and adding the basic oxide thereto. A preferred method comprises adsorbing the dyes (which may or may not have a spectral sensitizing function when used alone) on the basic oxide of the present invention and adding the basic oxide with the dyes adsorbed thereon to the silver halide emulsion or producing silver halide crystals in the presence of such a basic oxide with the dyes adsorbed thereon. Although the amount of the dyes is not limited, a preferred amount of the dyes ranges from about $10^{-6}$ to $10^{-3}$ mols per mol of the basic oxide.

Supersensitization can be carried out by a combination of spectral sensitizing dyes or can be carried out by a combination of a spectral sensitizing dye and a substantially colorless organic compound. In this case, the mechanism is not completely clear whether the dye changes its adsorption site onto the silver halide from the basic oxide by which the dye is adsorbed on the silver halide crystals or whether energy is transmitted effectually to the silver halide crystals without a change of the dye adsorption site.

Spectral sensitization techniques by using dyes are well-known. For example, the dyes described in U.S. Pat. Nos. 2,493,748, 2,519,001, 2,977,229, 3,480,434, 3,672,897, and 3,703,377 can be used to sensitive a blue sensitive emulsion, the dyes described in U.S. Pat. Nos. 2,688,545, 2,912,329, 3,397,060, 3,615,635 and 3,628,964, British Pat. Nos. 1,195,302, 1,242,588 and 1,293,862, German Pat. Publications (OLS) 2,030,326 and 2,121,780, and Japanese Pat. Publications Nos. 4936/1968 and 14030/1969 can be used to sensitize a green sensitive emulsion, and the dyes described in Japanese Pat. Publication Nos. 10773/1968 and U.S. Pat. Nos. 3,511,664, 3,522,052, 3,527,641, 3,615,613, 3,615,632, 3,617,295, 3,635,721, 3,694,217, 1,137,580 and 1,216,203 can be used to sensitize a red sensitive emulsion. These emulsion can be chosen suitably depending on the purpose or use of the sensitive materials to have a suitably sensitized wavelength range and speed, etc.

In the present invention, cyanine dyes (particularly, carbocyanine dyes) or xanthene dyes are preferred. Examples of such dyes which can be used are described below.

BLUE SENSITIVE EMULSION

U.S. Pat. No. 2,493,748

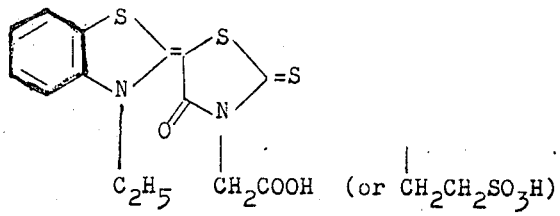

U.S. Patent 2,519,001

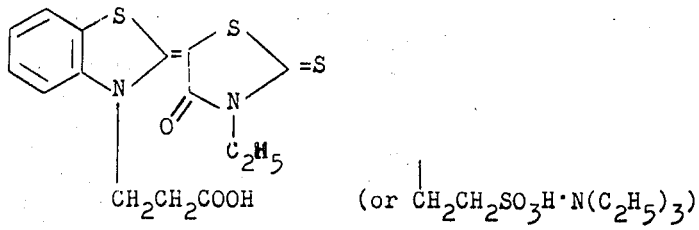

U.S. Patent 2,977,229

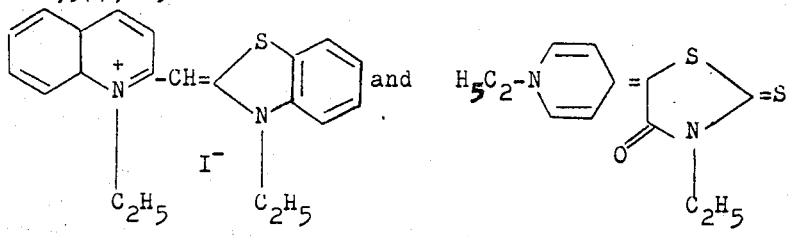

(in combination)

U.S. Patent 3,480,434
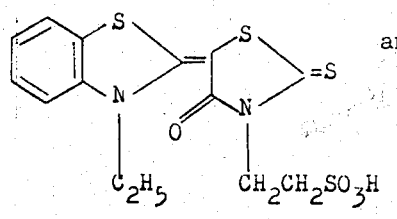
and a yellow coupler (in combination)
U.S. Patent 3,672,897
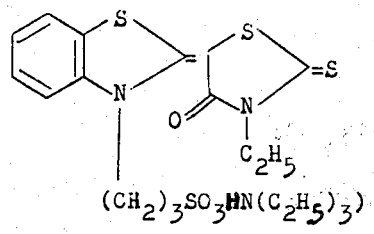
and a yellow coupler (in combination)
U.S. Patent 3,703,377
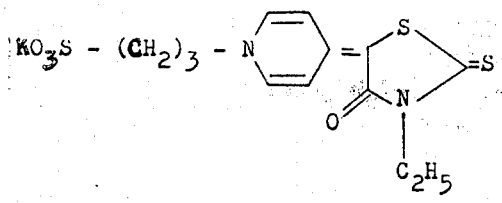
(in combination)
and
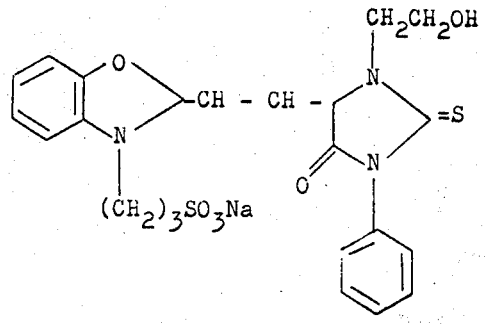
<u>Green Sensitive Emulsion</u>
U.S. Patent 2,688,545
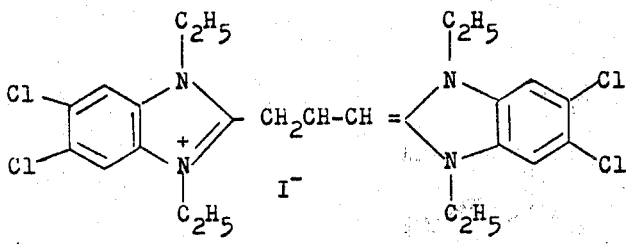
(in combination)

and
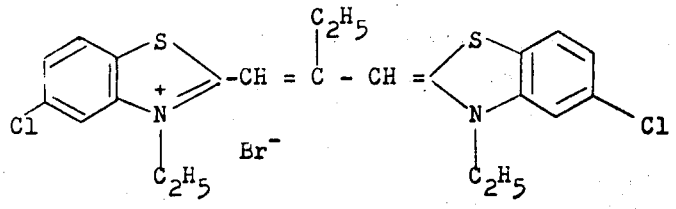
U.S. Patent 2,912,329
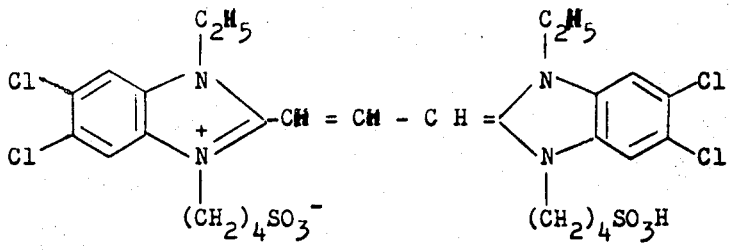
and
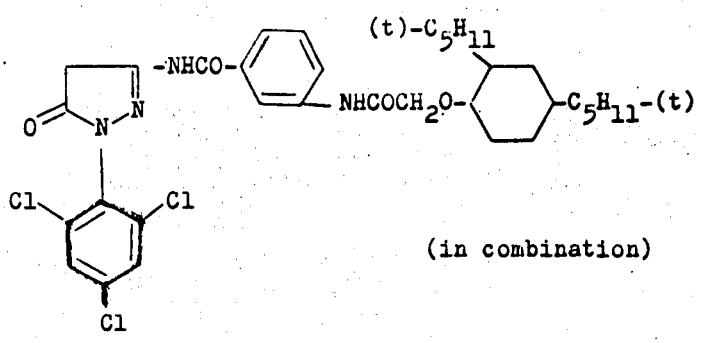
(in combination)
U.S. Patent 3,397,060
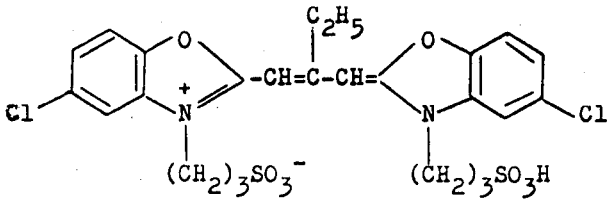
and
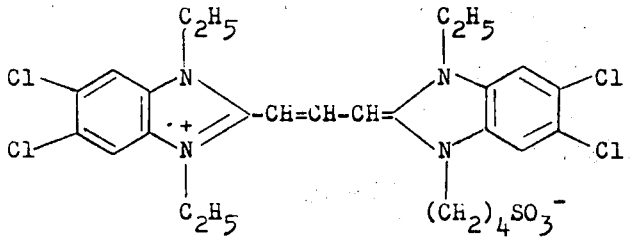
(in combination)

U.S. Patent 3,615,635
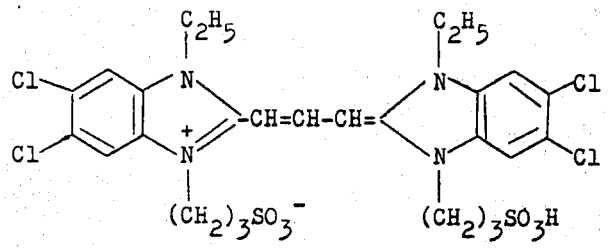
and
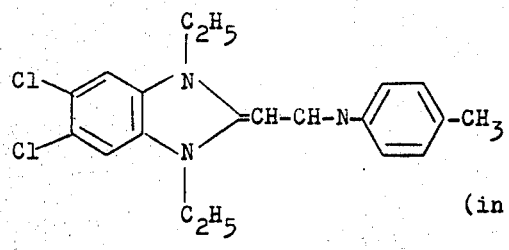
(in combination)
U.S. Patent 3,628,964
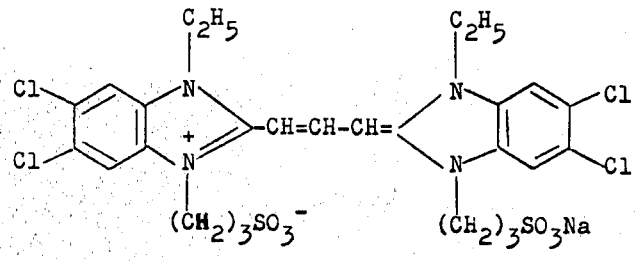
and
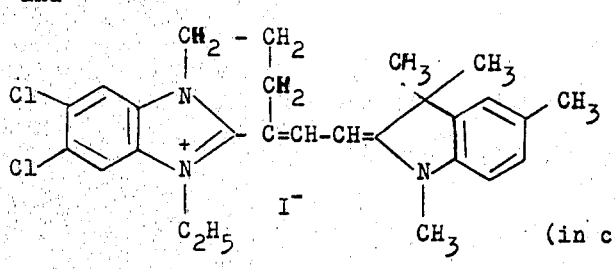
(in combination)
British Patent 1,195,302
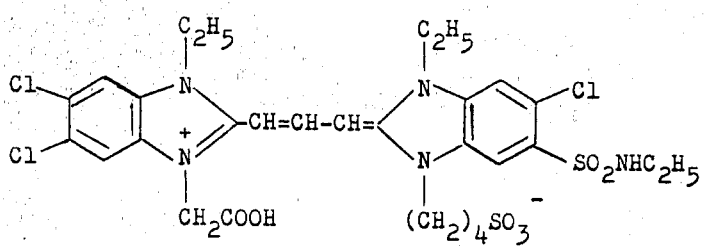

British Patent 1,242,588
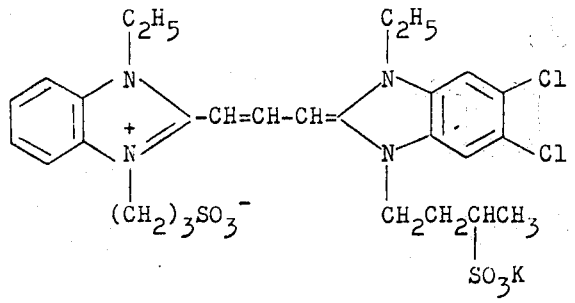
British Patent 1,293,862
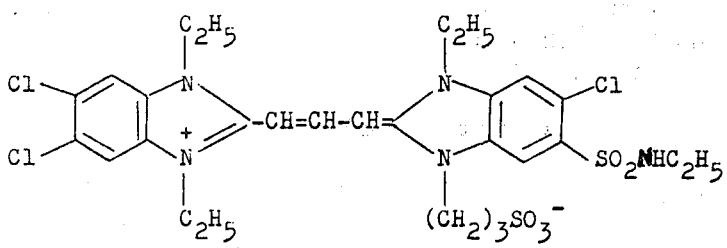
and
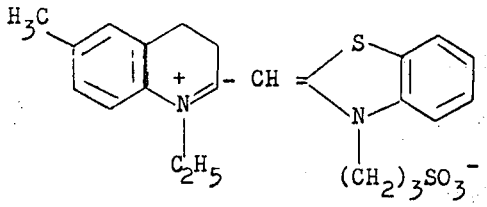
(in combination)
German Patent OLS 2,030,326
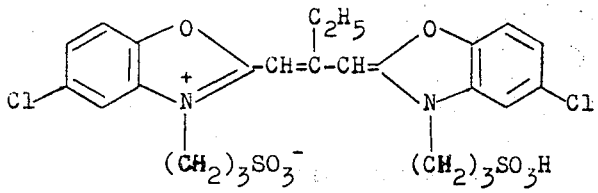
and
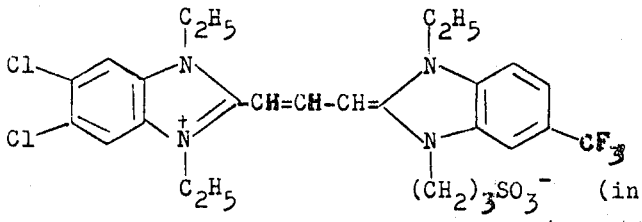
(in combination)

German Patent OLS 2,121,780
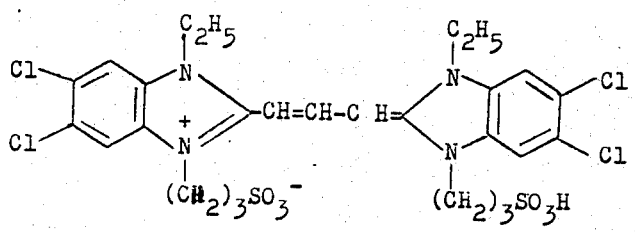
and
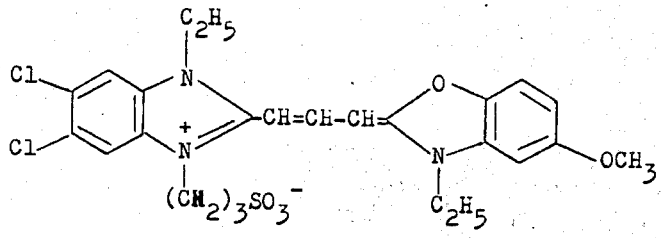
(in combination)
Japanese Patent Publication 4936/1968
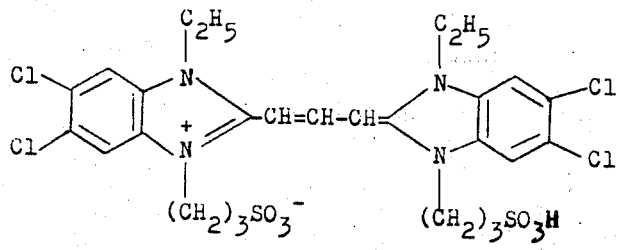
and
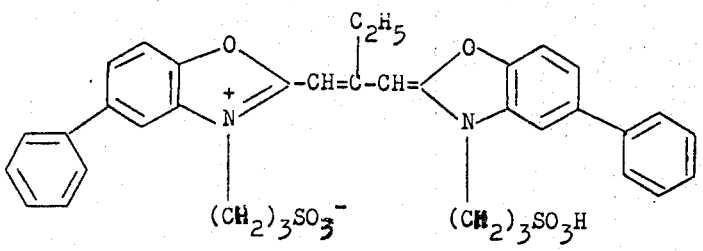
Japanese Patent Publication 14030/1969
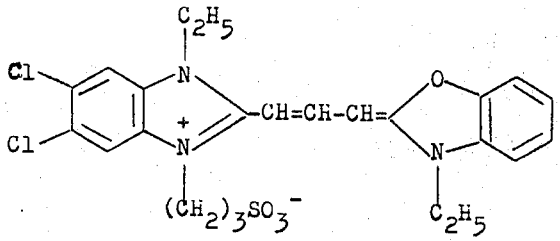

Red Sensitive Emulsion
Japanese Patent Publication 10773/1968
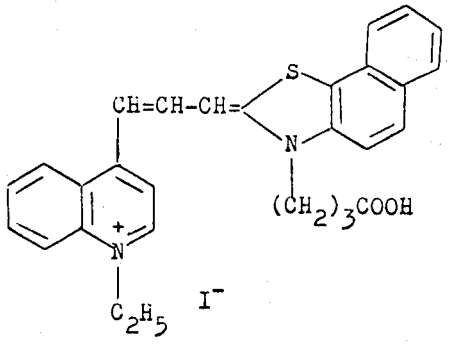
and
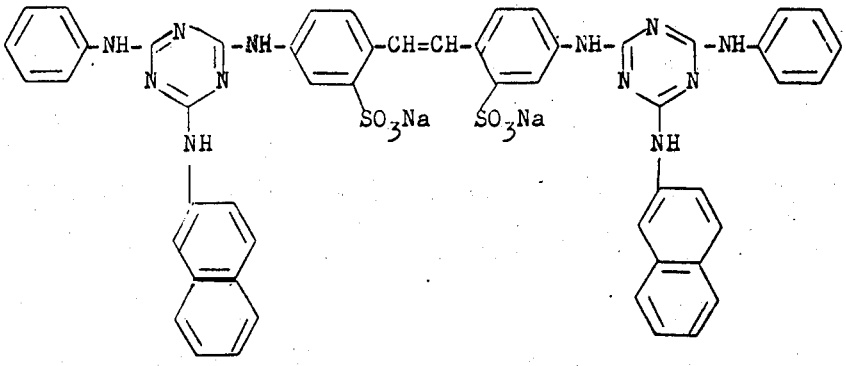
(in combination)
or
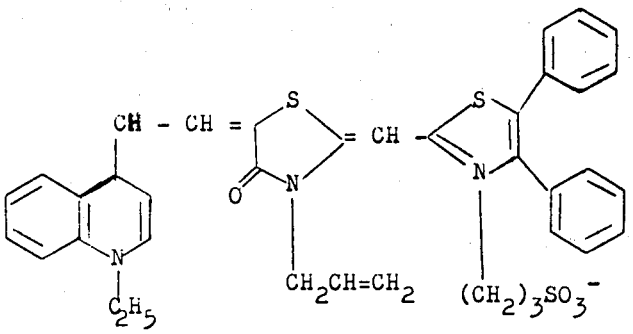
and
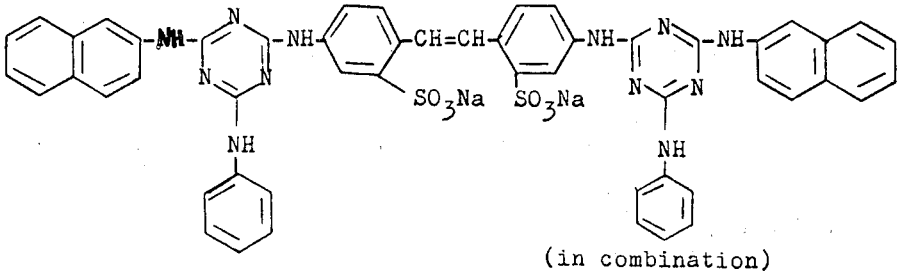
(in combination)

U.S. Patent 3,522,052
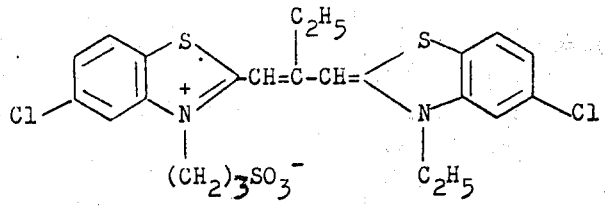
and
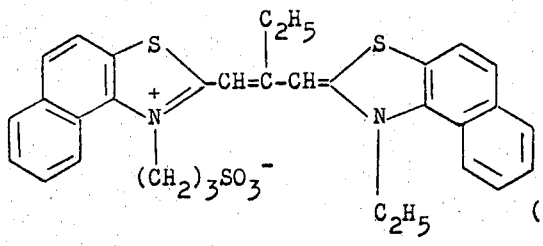
(in combination)
U.S. Patent 3,527,641
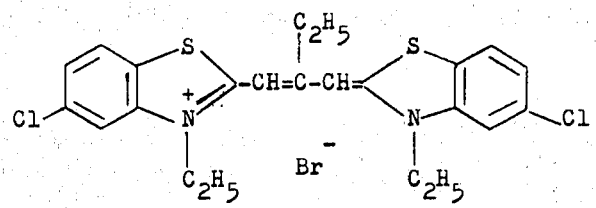
and
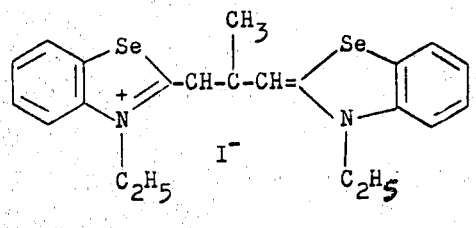
(in combination)
U.S. Patent 3,615,613
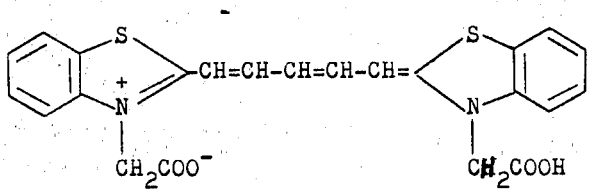
65 and
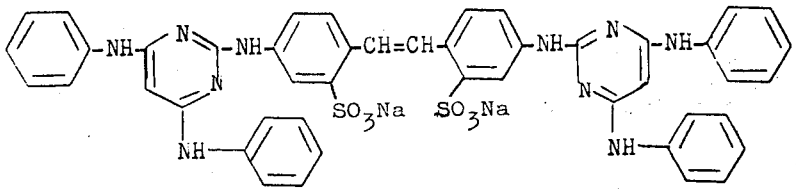
(in combination)
U.S. Patent 3,615,632
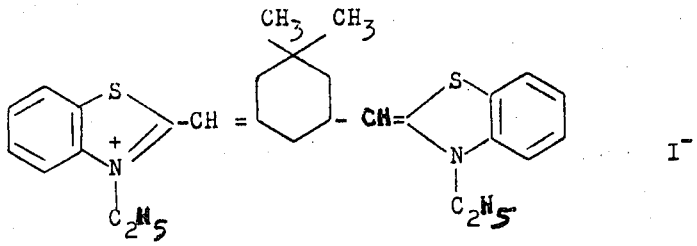
and
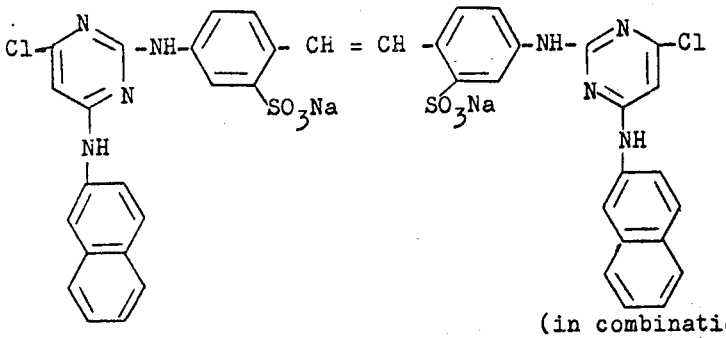
(in combination)
U.S. Patent 3,617,295
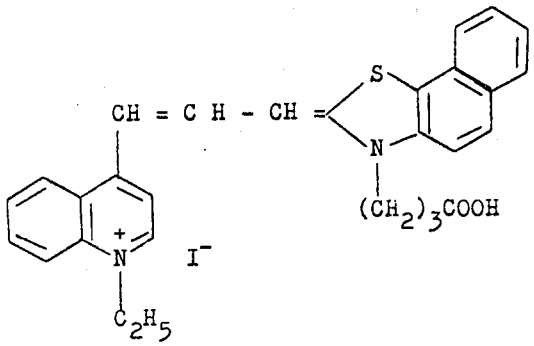

and
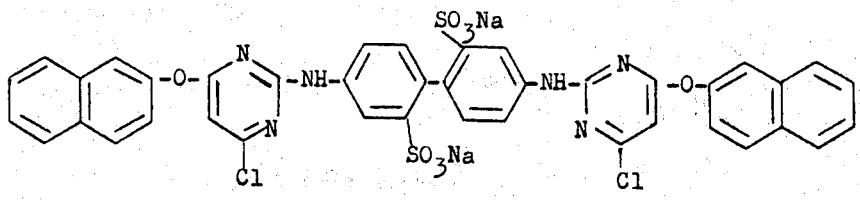
(in combination)
U.S. Patent 3,635,721
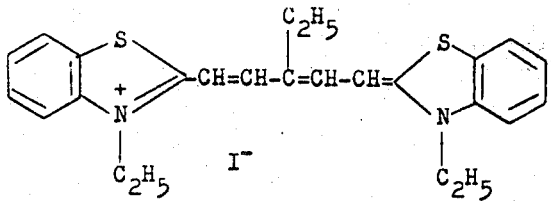
and
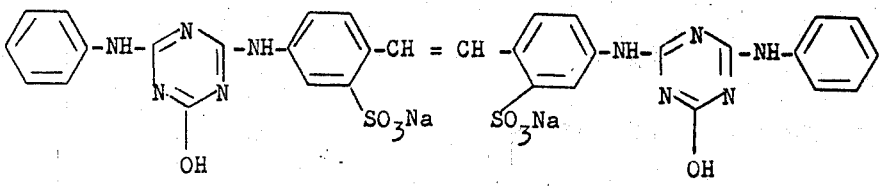
(in combination)
U.S. Patent 3,694,217
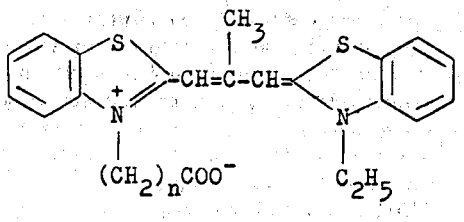
(or $SO_3^-$ )
British Patent 1,137,580
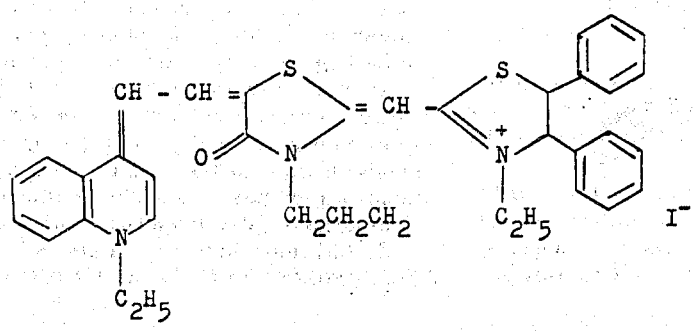

and

Condensate of 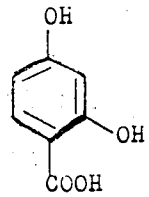 and HCHO (in combination)

British Patent 1,216,203

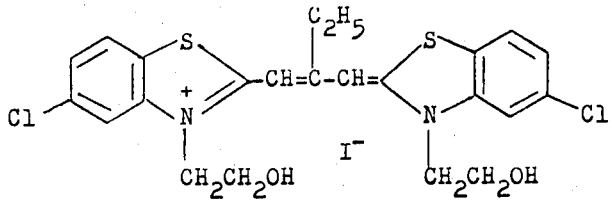

and

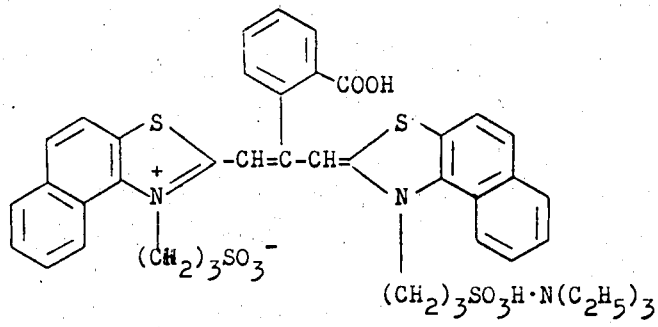

When the solid basic oxide is used, development is accelerated, because the pH becomes high at development, and consequently it becomes possible to shorten the developing time. In the prior art process, since the process has a tendency to generate fog if the pH is high, antifogging agents are used in order to minimize such defect. However, in this case, although the generation of fog can be prevented, problems due to densensitization occur. However, if a solid acid oxide is used in combination, it is possible to minimize the generation of fog without causing desensitization.

In order to obtain the effect of the present invention, the solid basic oxide in an amount sufficient to improve the sensitivity of silver halide can be added to the emulsions or can be present during formation of the silver halide. As a guide, the solid basic oxide is used in the amount of above about 0.05 mol, e.g., 0.05 mol to about 200 mols per mol of silver halide, preferably 0.5 mol to 30 mols per mol of silver halide. Particularly, a range of 1.5 to 15 mols per mol of silver halide is preferred.

The effect of the solid basic oxide depends upon various factors such as the particle size of the silver halide, the properties of the emulsions and type of the dyes or the solid basic oxide, etc.

The solid basic oxide is either commercially available or can be synthesized using known processes. The particle size of the solid basic oxide can be changed by means of a ball mill, a grinder or ultrasonic waves. A suitable particle size of the solid basic oxide, and also of the acid oxide, can range from about 0.05 to 0.2 microns.

The effect brought about by the solid basic oxide can be compared in a known manner wherein a photosensitive material produced by applying an emulsion of the prior art to a support and a photosensitive material produced by applying an emulsion of the present invention to a support are processed under the same conditions using a developer, for example, such as Papitol, Microfine (tradename, produced by Fuji Photo Film Co., Ltd.) and a fixing agent, for example, such as Super Fujifix (trade name, produced by Fuji Photo Film Co., Ltd.) according to a known processing sequence comprising development, stopping and fixing. The emulsion of the present invention can contain a coupler. In using a photosensitive material containing a coupler, the effect brought by the solid basic oxide can be evaluated by comparison with dye images which are formed by conventional color development.

In the present invention, the addition of the coupler to the emulsion can be carried out using a method which comprises dissolving the coupler in an olesphilic solvent and dispersing the resulting solution in the emulsion or a method which comprises adding the coupler as an aqueous alkaline solution.

For example, the couplers described in U.S. Pat. Nos. 2,875,057 and 3,265,506, Japanese Pat. Pub. Nos. 5582/1967, 19955/1969 and 19956/1970 and Japanese Pat. Pub. (OPI) 26133/1972 and 66836/1973 can be used for a blue sensitive emulsion, the couplers described in U.S. Pat. Nos. 2,600,788, 2,983,608, 3,062,653 and 3,476,560, British Pat. No. 956,261, Japanese Pat. Pub. No. 20636/1970 and Japanese Pat. Pub. (OPI) No. 26133/1972 can be used for a green sensitive emulsion, and the couplers described in U.S. Pat. Nos. 3,591,383, 2,474,293, 2,698,794 and 3,034,892 and Japanese Pat. Pub. No. 11304/1967 and 32461/1969 can be used for a red sensitive emulsion. In addition, the DIR couplers described in U.S. Pat. Nos. 3,379,529, 3,617,291, 3,705,801, 3,516,831, 3,253,924, 3,311,476, 3,227,554 and 3,297,445 and German Pat. (OLS) No. 2,163,811 can of course be used.

Suitable supports which can be used are paper (including baryta paper, synthetic paper and laminated paper, metal plates, and synthetic and natural polymer films. Particularly, paper, an aluminium plate, a polyethylene terephthalate film and a cellulose triacetate film are used. A suitable coating amount of the silver halide can range from about 0.05 to 30 g (as silver)/m$^2$ of the support.

As the binder for the silver halide crystals, gelatin is particularly preferred. However, acylated gelatin (phthalated gelatin and malonated gelatin, etc., colloidal albumin, proteins such as casein, cellulose derivatives such as carboxymethyl cellulose and hydroxyethyl cellulose, agar agar, sodium alginate, saccharides such as starch compounds, synthetic hydrophilic colloids such as polyvinyl alcohol, poly-N-vinyl pyrrolidone, polyacrylic acid copolymers, polyacrylamide and derivatives thereof or partially hydrolyzed products of these compounds can be used.

FIG. 1 shows a comparison of a characteristic curve of a silver chloride emulsion of the prior art (curve 1) and a characteristic curve of a silver chloride emulsion containing magnesium oxide of the present invention (curve 2). It can be understood from this figure that an emulsion containing magnesium oxide has a sensitivity about 3 times that of an emulsion not containing magnesium oxide. Further, in the present invention, other photographic properties are not adversely affected.

FIG. 2 shows spectra of spectral sensitivity of the silver halide emulsions. Curve (*a*) is a spectrum of an emulsion of the prior art and curve (*b*) is a spectrum of an emulsion of the present invention. It can be seen that sensitization ability to incident active rays is markedly improved by addition of magnesium oxide. Furthermore, the emulsion becomes sensitive to lower energy rays, which is an unexpected phenomenon. Magnesium oxide is a white powder which can be used as a standard white plate and has no absorption in a visible range. Accordingly, this phenomenon is outstanding.

This phenomenon can be understood if it is considered that the magnesium oxide amplifies the image formation efficiency of the silver halide. However, it is not clear why the amplification occurs.

FIG. 3 shows the spectra of cyan coupler containing photosensitive materials which are sensitized by Dye II described hereinafter. In this figure, the prior art (curve (*a*) and the present invention (curve (*b*)) are provided for comparison. Dye II does not exhibit a spectral sensitization function itself. However, it will be understood that Dye II provides a spectral sensitization function in the presence of magnesium oxide.

FIG. 4 shows spectra of the spectral sensitivity of silver halide emulsions which are sensitized with erythrosine. In this figure, curve (*a*) is a spectrum of an emulsion of the prior art and (*b*) is a spectrum of an emulsion of the present invention. As is clear from this figure, spectral sensitization is accomplished effectively by the presence of magnesium oxide.

Some of the effects obtained in the present invention are summarized below.

1. The sensitivity of silver halide crystals (including an expansion of an inherent sensitivity range) increases.

2 The efficiency of the spectral sensitization function increases by use together with dyes.

3. It is possible to provide a spectral sensitization to the emulsion by using a dye which does not exhibit spectral sensitization itself when used alone together with a solid basic oxide.

4. Desensitization in the inherent sensitivity range which is observed in the prior art is minimized when sensitization with dyes is carried out 5. The developing time is shortened because the development is accelerated.

6. Conventional chemical sensitization can also be employed.

7. Use of the emulsions of the present invention is not limited. Particularly, they are suitable as emulsions for printing papers (color papers).

The dyes used for demonstration of the effects of this invention were as follows.

Dye I

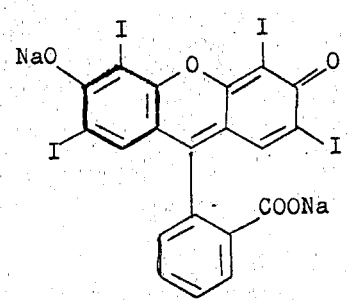

Dye II

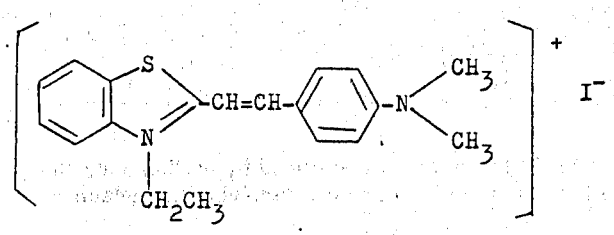

Dye III

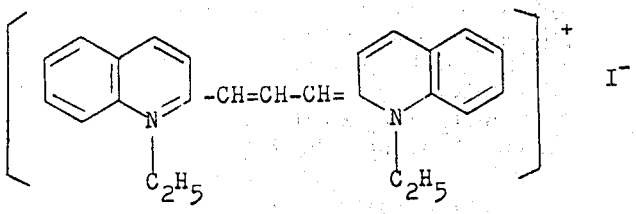

Dye IV

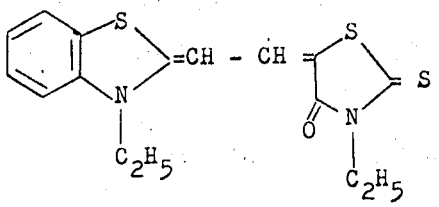

The following examples are given in order to illustrate the present invention in greater detail. However, the present invention is not to be construed as being limited, to these examples. Unless otherwise indicated, all parts, percents, ratios and the like are by weight.

| COMPARISON EXAMPLE | |
|---|---|
| First Solution | |
| Ammonium Chloride | 275 g |
| Hydrochloric Acid | 12.5 ml |
| Gelatin | 1,225 g |
| Water | 7,500 ml |
| Second Solution | |
| Silver Nitrate | 500 g |
| Water | 1,200 ml |

The above solutions were prepared. The first solution was produced by swelling gelatin in water for 30 minutes, adding the hydrochloric acid and the ammonium chloride, and dissolving the gelatin at 50°C. The second solution was added slowly to the first solution while stirring the mixture vigorously.

The mixture was then ripened at 44°C for 30 minutes, solidified and washed with water. The resulting emulsion was applied to baryta paper and dried.

| EXAMPLE 1 | |
|---|---|
| First Solution | |
| Ammonium Chloride | 275 g |
| Hydrochloric Acid | 12.5 ml |
| Magnesium Oxide | 985 g |
| Gelatin | 1,225 g |
| Water | 7,500 ml |
| Second Solution | |
| Silver Nitrate | 500 g |
| Water | 1,200 ml |

The first solution was produced by swelling the gelatin in water for 30 minutes, dissolving the gelatin by heating to 50°C and adding the hydrochloric acid and the ammonium chloride and the magnesium oxide. Then the second solution was added slowly to the first solution while stirring the mixture vigorously. The resulting mixture is ripened at 44°C for 30 minutes, solidified and washed with water to produce an emulsion. This emulsion was applied to baryta paper and dried.

The photosensitive materials produced in the Comparison Example and Example 1 were exposed to light (1,000 luxes for 3 seconds) through a step wedge under the same exposure conditions. Then they were subjected to development, stopping, fixing and water washing in a conventional manner and characteristic curves were determined. The results obtained are shown in FIG. 1. In the figure, the abscissa is the relative exposure and the ordinate is the photographic reflection density. Curve 1 is a characteristic curve of the photosensitive material (which does not contain MgO) of the prior art and curve 2 is a characteristic curve of the photosensitive material (which contain MgO) of the present invention. As is clear from this figure, a higher density can be obtained with less exposure if MgO is present. The sensitivity was evaluated as the reciprocal of the exposure necessary to provide a density of (fog density + 0.1), which is shown in Table 1. As is clear from this table, it is possible to increase the sensitivity 29 times, if magnesium oxide is added.

Table 1

| | Sensitivity |
|---|---|
| Prior Art (not containing MgO) | 1 |
| Present Invention (containing MgO) | 29 |

In the following examples, photosensitive materials which do not contain magnesium oxide were produced too, and these were compared under the same conditions with the photosensitive materials which contain magnesium oxide.

EXAMPLE 2

The following solutions were prepared.

| | |
|---|---|
| First Solution | |
| Potassium Chloride (5% aq. solution) | 20 ml |
| Magnesium Oxide | 14 g |
| Gelatin (6% aq. solution) | 500 ml |
| Sodium n-Dodecylbenzene Sulfonate (aq. solution) | 10 ml |
| Second Solution | |
| Silver Nitrate (5% aq. solution) | 20 ml |

After producing an emulsion in the same manner as in the Comparison Example the emulsion was applied to a polyethylene terephthalate film (thickess: 125 microns) to produce a photosensitive material.

A spectrum of the spectral sensitivity of the resulting photosensitive material is shown in FIG. 2 (*b*). FIG. 2 (*a*) is a spectrum of the spectral sensitivity of the photosensitive material which was produced in the same manner as described above but without using the magnesium oxide.

As is clear from this figure, the sensitivity to incident active rays used for forming silver images is amplified effectively by the addition of MgO to the silver chloride emulsion.

EXAMPLE 3

The following solutions were prepared.

| | |
|---|---|
| First Solution | |
| Potassium Bromide (1N aq. solution) | 10 ml |
| Potassium Iodide (1N aq. solution) 0.5 ml | |
| Gelatin | 6 g |
| Magnesium Oxide | 4 g |
| Water | 40 ml |
| Second Solution | |
| Silver Nitrate (1N) – Aqueous Ammonia Solution | 10 ml |
| Third Solution | |
| Dye II | 1.8 mg |
| Methanol | 20 ml |
| Acetone | 10 ml |

The second solution was prepared by dissolving silver nitrate in a concentrated aqueous ammonia solution, adding ammonia until the brownish black precipitates formed initially redissolved, and adding water thereto to adjust the pH of the solution to 1.

The second solution was added incrementally to the first solution while stirring the mixture vigorously. The mixture was ripened at 50°C for 40 minutes and solidified and washed with water. Then the emulsion was dissolved at 45°C and the third solution was added thereto while stirring the emulsion. Further, 1.2 g of the coupler represented by the following formula and 25 ml of dibutyl phthalate were added thereto. The emulsion produced was applied to baryta paper and dried.

Coupler

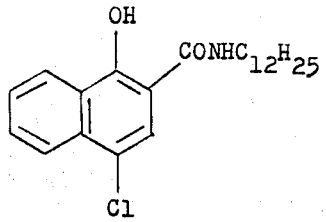

The spectrum of the spectral sensitivity of this photosensitive material is shown in FIG. 3 (*b*). The composition of the color developer used for determining the spectrum of predicted sensitivity was as follows.

| | |
|---|---|
| N,N-Diethyl-p-phenylenediamine Sulfate | 10 g |
| Hydroxylamine Sulfate | 1 g |
| Sodium Ethylenediamine Tetraacetate | 2 g |
| Sodium Sulfite | 2 g |
| Sodium Carbonate | 30 g |
| Water | 1,000 ml |

The development was carried out at 20°C for 15 seconds. For comparison, a spectrum of the spectral sensitivity of the same emulsion as described above but without the magnesium oxide is shown in FIG. 3 (*a*).

As is clear from FIG. 3, although Dye II does not show a spectral sensitization effect for the prior art emulsion, a marked spectral sensitization effect appears if the Dye II is used together with magnesium oxide. Magnesium oxide is colorless and does not have absorption in a visible range itself. Accordingly, the effect brought about by the magnesium oxide is unexpected and would not be preducted from a mere consideration concerning energy levels.

EXAMPLE 4

The same first solution and second solution as in Example 2 and the following third solution were prepared.

| Third Solution | |
|---|---|
| Dye I | 6 mg |
| Methanol | 100 ml |

The second solution was added incrementally to the first solution while stirring the mixture vigorously at 50°C. After ripening at 50°C for 1 hour, the mixture was solidified and washed with water. Then, the mixture was dissolved again. The third solution was then added thereto and the mixture stirred for homogeneity. The resulting emulsion was applied to baryta paper and dried.

A spectrum of the spectral sensitivity of this photosensitive material is shown in FIG. 4 (*b*). A spectrum of the spectral sensitivity of a photosensitive material which does not contain magnesium oxide is shown in FIG. 4 (*a*). It is clear from a comparison of FIG. 4 (*a*) and FIG. 4 (*b*) that a good result can be obtained by the addition of magnesium oxide. The sensitivity to incident active rays used for forming silver images increases effectively in both of the inherent sensitivity range or a spectral sensitization range.

EXAMPLE 5

After dissolved 0.3 g of Dye III in 1 liter of methanol, 20 g of magnesium oxide was added and dispersed utilizing ultrasonic waves for 5 minutes. After allowing the dispersion to stand for 2 hours, the dispersion was filtered and dried to produce magnesium oxide containing Dye II adsorbed thereon.

To ¼ of the total amount of the emulsion which was produced in the same manner as in Example 2 but using potassium bromide instead of potassium chloride in tne first solution, 0.5 g of the above described magnesium oxide containing the Dye II adsorbed thereon was added. The mixture was stirred to disperse the magnesium oxide homogeneously in the gelatin together with the silver bromide. This emulsion was applied to a cellulose triacetate film and dried.

In this sensitive material a sensitization effect 4.6 times that of the photosensitive material which was sensitized using only Dye III and did not contain magnesium oxide was obtained.

EXAMPLES 6 to 14

In the following Table 2, the results of Example 3 and other examples are shown together.

In Examples 6 and 7, the same emulsion as in Example 3 was used.

Table 2

| Example | Composition of Silver Halide | Sensitizing Dye | Solid Basic Oxide | Solid Acid Oxide | Comparative Degree of Sensitization* |
|---|---|---|---|---|---|
| 3 | AgBr | Dye II | MgO | — | 55 |
| 6 | AgBr | Dye II | MgO | $TiO_2$ | 35 |
| 7 | AgBr | Dye IV | MgO | — | 3.3 |
| 8 | AgClBr (Cl 40%)** | Dye I | MgO | — | 7.7 |
| 9 | AgClBr (Cl 40%) | Dye II | MgO | — | 5.5 |
| 10 | AgCl | — | MgO | — | 10 |
| 11 | AgClBr (Cl 40%) | — | CaO | — | 3.4 |
| 12 | AgClBr (Cl 40%) | — | $ZnO/Al_2O_3$*** | — | 1.6 |
| 13 | AgClBr (Cl 40%) | — | MgO | $Al_2O_3$ | 2 |
| 14 | AgClBr (Cl 40%) | — | CaO | $Al_2O_3$ | 4.3 |

*Compared to control which did not contain the solid basic oxide with the control sensitivity being = 1
**Halide composition in mole %
***Compound oxide While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion having improved sensitivity which comprises an emulsion containing photosensitive silver halide crystals and a sensitizing amount of at least one solid basic metal oxide selected from the group consisting of magnesium oxide, calcium oxide and a compound oxide of zinc and aluminium.

2. The silver halide photographic emulsion of claim 1, wherein said solid basic metal oxide is present in said emulsion in an amount of above about 0.05 mol of said solid basic metal oxide per mole of silver halide.

3. The silver halide photographic emulsion of claim 1, wherein the particle size of said solid basic metal oxide ranges from about 0.05 to 20 microns.

4. The silver halide photographic emulsion of claim 1, including at least one of a solid acid metal oxide which does not have any substantial sensitization effect when used alone in said silver halide emulsion.

5. The silver halide photographic emulsion of claim 4, wherein said solid acid metal oxide is aluminum oxide, titanium oxide, vanadium oxide or cerium oxide.

6. The silver halide photographic emulsion of claim 4, wherein the weight proportion of said basic oxide to said acid oxide ranges from about 1:10 to 10:1.

7. The silver halide photographic emulsion of claim 1, including a spectrally sensitizing dye.

8. The silver halide photographic emulsion as set forth in claim 7, wherein said sensitizing dye is a cyanine dye, a merocyanine dye, a xanthene dye, an acridine dye, a hemicyanine dye, a styryl dye, or a mixture thereof.

9. The silver halide photographic emulsion of claim 7, wherein said sensitizing dye is present in an amount of about $10^{-6}$ to $10^{-3}$ mole per mole of said basic oxide.

10. The silver halide photographic emulsion of claim 1, including a color coupler.

11. The silver halide photographic emulsion of claim 7, wherein said sensitizing dye is added to said silver halide emulsion by adsorbing said sensitizing dye on said metal oxide and adding said metal oxide having said sensitizing dye adsorbed thereon to said silver halide emulsion during or after the preparation thereof.

12. A photographic material comprising a support having thereon the silver halide photographic emulsion of claim 1.

* * * * *